United States Patent [19]

Wagenseil et al.

[11] Patent Number: 4,602,554

[45] Date of Patent: Jul. 29, 1986

[54] AXIAL PISTON MACHINE, MORE PARTICULARLY AXIAL PISTON PUMP OF THE INCLINED DISC OR SKEW AXIS TYPE

[75] Inventors: Ludwig Wagenseil, Vohringen; Manfred Lotter, Neu-Ulm, both of Fed. Rep. of Germany

[73] Assignee: Hydromatik GmbH, Elchingen, Fed. Rep. of Germany

[21] Appl. No.: 716,041

[22] Filed: Mar. 26, 1985

[30] Foreign Application Priority Data

Apr. 6, 1984 [DE] Fed. Rep. of Germany ..... 3413059

[51] Int. Cl.[4] ..... F01B 13/04

[52] U.S. Cl. ..... 91/486; 91/499; 91/506

[58] Field of Search ..... 91/484–487, 91/499, 506, 507

[56] References Cited

U.S. PATENT DOCUMENTS

| | | | |
|---|---|---|---|
| 3,046,906 | 7/1962 | Budzich | 91/506 |
| 3,075,472 | 1/1963 | Garnier | 91/486 |
| 3,444,690 | 5/1969 | Henry-Biabaud | 91/506 |
| 3,657,970 | 4/1972 | Kobayashi | 91/487 |

FOREIGN PATENT DOCUMENTS

| | | | |
|---|---|---|---|
| 2152568 | 4/1972 | Fed. Rep. of Germany | 91/499 |
| 2250510 | 4/1974 | Fed. Rep. of Germany | 91/487 |
| 311938 | 5/1929 | United Kingdom | 91/485 |

*Primary Examiner*—William L. Freeh

*Attorney, Agent, or Firm*—Scully, Scott, Murphy & Presser

[57] ABSTRACT

The invention is concerned with an axial piston machine, preferably an axial piston pump of the inclined disc or skew axis type, with a cylinder (9) which rotates about an axis of rotation and in which, on a pitch circle, several pistons (8) are movably guided in piston bores (11) extending substantially along the axis of rotation (3), by means of an inclined or driving disc, or the like, the piston bores (11) opening at the face of the cylinder (9) which is remote from the inclined or driving disc (5), the face resting against a control surface (13) in which there are arranged control openings (14), positioned on the pitch circle of the pistons (8) which, in set positions of rotation of the cylinder (9) are covered by the openings of the piston bores (11), loading cylinders (24) being distributed over the circumference and acting upon the cylinder (9) against the control surface (13), and of which loading cylinders the working spaces are connected, by means of connecting channels (27), each with a respective piston bore (11) and the cylinder (9) being supported radially, directly or indirectly, on a support (18) which is fixed relative to the housing (2) and which is spaced axially from the control surface. It is the purpose of the invention, to so arrange the axial piston machine that a balanced axial and radial guidance of the cylinder (9) is possible with maximum use of the piston performance. For achieving this it is arranged that the piston bores (11) open, without narrowing of cross section, at said face (23); that said face (23) is spherically concave and the control surface (13) is correspondingly spherically convex; that the axial portion ($F_{SK}$) of a control surface force ($F_S$), which acts upon the cylinder (9) in the direction of the inclined or driving disc, or counterbalances a loading force ($F_{ER}$) which acts upon the cylinder in the opposite direction; and that the size of the radius (R) of the control surface (13) is such that the intersecting point (s) of the control surface force ($F_S$) perpendicular to the control surface (13) and of the loading force ($F_{ER}$) lies in a plane (A) which extends transversely to the axis of rotation (3) and which is arranged in the region of the support (18) of the cylinder (9).

10 Claims, 5 Drawing Figures

35

W
34
W1
24,26
33
8,11
13
24,26
14
8,11
26

AXIAL PISTON MACHINE, MORE PARTICULARLY AXIAL PISTON PUMP OF THE INCLINED DISC OR SKEW AXIS TYPE

BRIEF DESCRIPTION OF THE PRIOR ART

In axial piston machines of this type there is clean movement and satisfactory sealing of the cylinder receiving the piston on the control surface only when the forces acting on the cylinder during operation are dimensioned in such a way that, on the one hand, the cylinder is prevented from being lifted, even only partially, from the control surface and, on the other hand, contact pressure of the cylinder against the control surface is such that an oil film, which prevents increased wear, is able to form on the control surface. In the present context, the forces which act on the cylinder in an axial direction should firstly be considered. One such, is a so-called control surface force which, during operation, attempts to lift the cylinder from the control surface. The control surface force results from the sum of the partial pressures times area over the entire pressure field and possible gap pressures. The control surface force is therefore represented by a resultant force which is perpendicular to the control surface.

It is known from DE-OS No. 22 50 510 to work against the control surface force through an opposite loading force which loads the cylinder against the control surface. This is achieved by means of two measures. On the one hand, the piston bores have a shoulder, formed by a narrowing of cross section, against which the loading forces act. Moreover, it is known from DE-OS No. 22 50 510 to produce loading forces by means of loading pistons, distributed over the circumference, which are supported against the machine housing and which can be acted upon either by spring pressure or, as hydraulic pistons, by the working pressure, and load the cylinder in the direction of the control surface.

In the prior art disclosed in DE-OS No. 22 50 510, the cylinder is supported, for the purpose of so-called kinematic guidance, on the driving shaft of an inclined disc axial piston machine. That is to say, the cylinder is able to adjust automatically to the control surface, although other tilting motions of the cylinder are also possible which—as already described at the beginning—cause the cylinder to be lifted from the control surface.

Prior art which is comparable with the prior art described above is also disclosed in DE-PS No. 941 343. In this construction, the effectiveness of the balancing cylinders is dependent upon the pressure state in the piston bores. For this, each loading cylinder is connected with a nearby located piston bore by means of a connecting channel. The cylinder is supported by means of a roller bearing, which prevents any automatic gap adjustment.

It is common to both known constructions that the narrowed cross sections of the piston bores form flow bottlenecks which have an adverse effect on the respective flow of hydraulic medium. Moreover, the requirements described at the beginning, which ensure that the cylinder is guided correctly on the control surface, are not met. In the construction according to DE-PS No. 941 343 no harmful contact pressure of the cylinder against the control surface would appear to be possible, as the cylinder on the face side is supported against an axial thrust bearing.

OBJECT OF THE INVENTION

The object underlying the invention is to develop an axial piston machine of the type described in the introduction, in such a way that, with maximum exploitation of the piston capacity, axially and radially balanced guidance of the cylinder is possible.

SUMMARY OF THE INVENTION

In the development according to the invention, piston bores are provided which open, without narrowing of cross section, at the face of the cylinder. As a result, the flow of hydraulic medium is not adversely affected, and the capacity of the pistons can be fully exploited, whereas, when there is a narrowing of cross section, as is the case in the prior art, a part of the capacity is lost due to the flow resistance. In contrast to the prior art, in the development according to the invention, the number and size of the loading cylinders is such that the axial forces acting upon the cylinder and directed towards the control surface counterbalance the forces acting upon the cylinder in the opposite direction, which are essentially comprised by the control surface force already described at the beginning. Account must be taken of the fact that both the loading force and the control surface force can comprise several component forces, for example the frictional forces acting when the piston is displaced also take effect in both axial directions, both on the control surface force and on the loading force. Moreover, the cylinder can be loaded continuously by a centric spring force, for example in the form of a pressure spring, against the pressure surface, as is the case in the prior art according to DE-OS No. 22 50 510. The component force produced by the spring is part of the loading force. Because of the spherical curve of the control surface, account should also be taken of the fact that the component forces of the control surface force, which are produced as a result of the pressure field and of the gap pressure on the control surface, are perpendicular to the control surface and therefore the components of these component forces, which are parallel to the piston, are smaller. This is a favourable consequence, as, when calculating the loading force, only the component of the control surface force which is parallel to the piston has to be taken into account. A spherical control surface produces a radial force component, yet the radial force component is harmless in the development according to the invention, as it acts in a transverse plane of the axial piston machine in which the cylinder is radially supported against a housing-fixed bearing and is therefore unable to exert a tilting moment on the cylinder.

In the development according to the invention, the cylinder is freed both axially and radially from significant harmful effects of force. This produces an optimum arrangement of the cylinder against the spherical control surface, where, as a result of the equilibrium between the control surface force and the loading force, an effective oil film is able to form between the control surface and the cylinder, thereby keeping friction and wear to a minimum.

The developments according to further disclosed features produce the same advantages. A specific feature is of significance for an axial piston machine of the inclined disc type in that the support according to the invention is able to be formed by the driving shaft. Another feature is directed to an axial piston machine of the skew axis type. In the case of this construction, by virtue of design, support of the radial force component in the mean swivelling plane of the driving disc can be advantageous.

According to another aspect the support plane and the wobble plane of the inclined disc or of the driving disc intersect in the axis of rotation. This is advantageous because there can be a reduction in the bending forces in the ends projecting from the cylinder, in which forces may occur as a result of the piston play in the piston bores.

According to another embodiment the piston bores run in a straight line in the cylinder. This is advantageous because the flow of hydraulic medium does not have to be deflected, as is the case in the prior art from DE-PS No. 941 343.

Another development according to the invention is advantageous for two different reasons. On the one hand, the piston path tapering conically towards the control surface produces a smaller radius for the control openings in the control surface. As a result, due to a comparatively small pressure field and the shorter lever arm, the component forces of the control surface force which are produced are smaller, which makes smaller loading cylinders possible. On the other hand, this development provides overall space for the loading cylinders.

A further advantageous development ensures that the pistons of the loading cylinders always rest against their effective surface, and therefore the cylinder also rests against the control surface, even in the pressureless state. An additional advantage of the initial spring tension for the pistons of the loading cylinders can be seen in the fact that, due to the relatively large distance of the axis of rotation, the spring force in the loading cylinders is very effective against tilting moments which act radially upon the cylinder and which may be caused, for example, by turbulences in the flow of medium or by inertia forces. It should be mentioned by way of comparison here that normal axial spring forces for contact pressure of the cylinder against the control surface in the zone of the driving shaft are less effective, as the effective distance designed therefor is small.

Both for reasons of cost and for reasons of overall size, to provide the development according to claim 8, it being advisable to bore through the pistons of the loading cylinders for the purpose of automatic lubrication of the friction bearing.

According to another modification, each piston a loading cylinder with line connection between the associated piston bores and loading cylinders.

Another inventive aspect provides adjustment of the balancing force produced by the loading cylinders to the actual pressure progression in the piston spaces, which, for structural and physical reasons, is, as it were, phase-shifted in a circumferential direction relative to the cylinder.

BRIEF DESCRIPTION OF THE DRAWINGS

Four exemplary embodiments of the invention are described in the following, with reference to a simplified drawing.

DETAILED DESCRIPTION OF THE INVENTION

Figure 2:
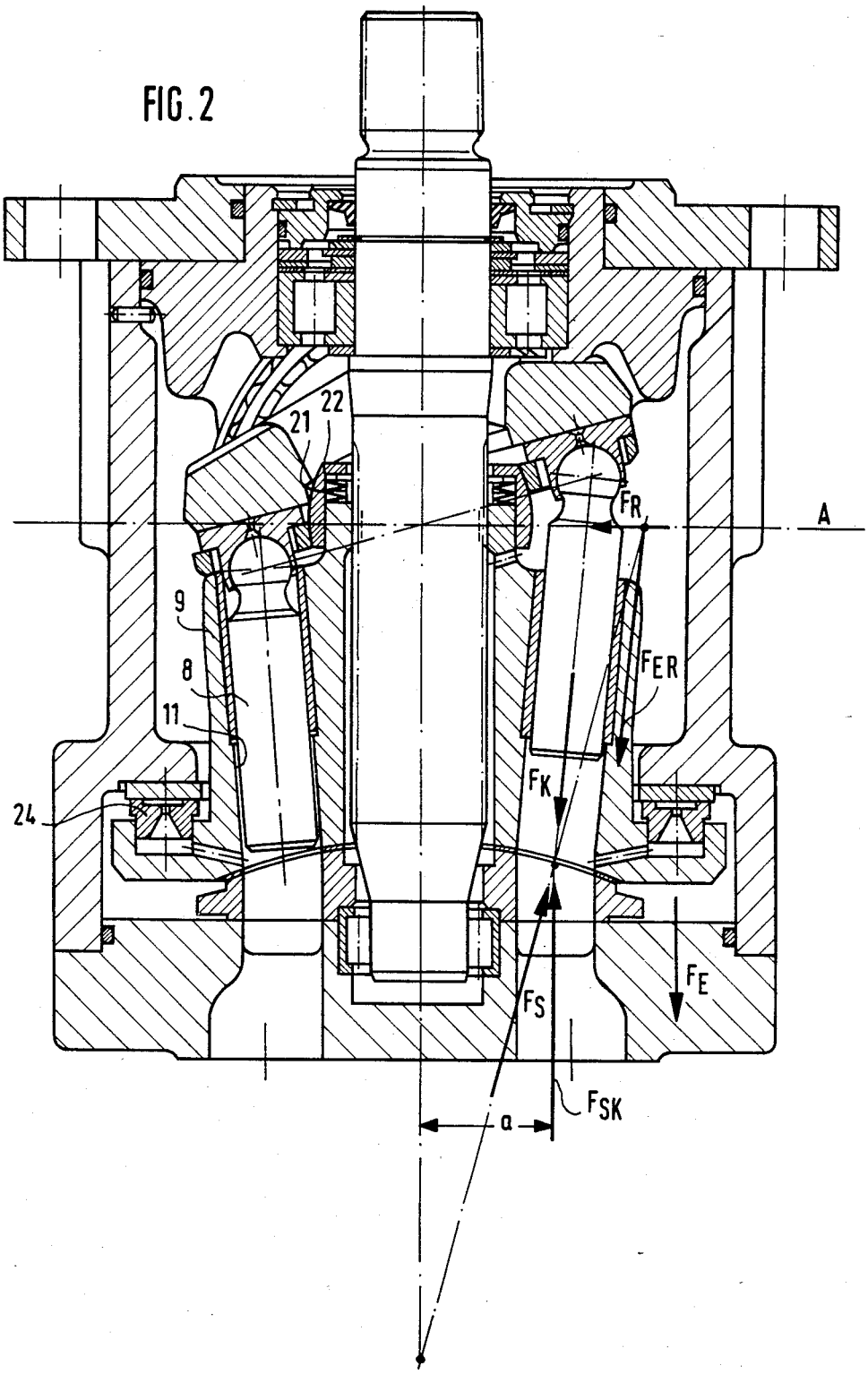
FIG. 2 shows an axial cross section through an axial piston machine according to the invention, as a second exemplary embodiment.

The axial piston machine, denoted generally with 1 in FIG. 2, which can be operated as pump and as motor, comprises a housing, denoted generally with 2, a drive shaft 4 mounted therein to rotate about an axis 3, a so-called inclined disc 5 against which pistons 8, distributed over a pitch circle, are held by means of sliding blocks 6 and a contact pressure plate 7, a cylinder 9 which rotates about the axis of rotation 3 by means of the driving shaft 4 and in which the pistons 8 are movably guided in axially extending piston bores 11, and a control plate 12, immovably secured to the housing 2, the spherical, convex control surface 13 of which has kidney-shaped control openings 14 which, as the cylinder 9 rotates, may or may not be covered by the piston bores 11 and therefore control, in the manner of valves, pump operation or motor operation of the axial piston machine 1.

The pistons 8 are driven by the inclined disc 5, against which the pistons 8 are held only axially. That is to say, as the cylinder 9 rotates, the sliding blocks 6 slide in a circumferential direction against the inclined disc 5, thereby producing the axial movement of the pistons 8.

The face of the cylinder 9 which faces the control surface 13 is spherically concave corresponding with the curve of the control surface 13 and lies sealingly against the control surface 13.

The cylinder 9 has a bore 15 through which a driving shaft 4 engages with play, and which driving shaft is supported in the region of its ends by means of roller bearings 16 and 17. The cylinder 9 is supported against the driving shaft 4 only at its end which is remote from the control surface 13, by a radially acting support 18. Between the driving shaft 4 and the support 18 there is a rotational-drive connection 19, acting in a circumferential direction, in the form of a keyway connection. The cylinder 9 is prestressed against the control surface 13 by means of one or more pressure springs 21 which act against the face of the cylinder 9 remote from the control surface 13 and are supported against a spherical bearing part 22 which encloses the cylinder 9 with a cylindrical bore, and, on the outer spherical surface of which, the contact pressure plate 7 slides, in pendulum fashion.

The support 18 is arranged in the region of a plane, denoted with A, which, at the same time, is also the mean swivelling plane of the inclined disc 5.

When the axial piston machine 1 is in operation, the cylinder 9 is acted upon by a control surface force, denoted generally with $F_S$, which is perpendicular to the control surface 13 and which attempts to lift the cylinder 9 from the control surface 13, and by a resultant axial loading force, denoted generally with $F_{ER}$, which acts upon the cylinder 9 against the control surface 13. The control surface force $F_S$ is produced substantially as the sum of the partial pressures over the entire pressure field and possible gap pressures which are able to build up between the control surface 13 and the face 23 of the cylinder 9 which slides thereon, and which attempt to lift the cylinder 9 from the control surface 13. The control surface force $F_S$ is influenced by several component forces, e.g. the frictional forces which act in both axial directions as a result of displacement of the pistons 8 and as a result of the flow against the walls of the piston bores 11. For reasons of simplification, there is no further description of these component forces. The resultant loading force $F_{ER}$ likewise comprises several component forces and, in particular, a loading force $F_E$, by means of which loading cylinders 24, distributed over the circumference, act upon the cylinder 9 in the direction of the control surface 13. The resultant loading force $F_{ER}$ also comprises piston forces, denoted generally with $F_K$, which, as already in the case of the description of the control surface force $F_S$, are not discussed in further detail. The force (not described in greater detail) produced by the pressure springs 21 also influences the resultant loading force $F_{ER}$ The pistons of the loading cylinders 24 are denoted with 25, and the associated working spaces are denoted with 26. As shown clearly in FIG. 4, there is associated with each piston 8 a loading cylinder 24, the piston bores 11 being connected with the associated working spaces 26 of the loading cylinders 24 by means of radial channels 27. The loading pistons 25 are supported against the housing 2 by means of a slip or bearing ring 28. They are bored through for the purpose of automatic lubrication of the sliding surface 29 at 31. Whereas the bearing ring 28 is fixedly secured to the housing 2, the loading pistons 25 participate in the rotation of the cylinder 9. In order to receive the loading cylinders 24, the cylinder 9 has a flange 32.

Both the control surface force $F_S$ and the loading force FE produced by the loading cylinders 24 are pulsating forces. This results from the build up and drop respectively of pressure in the piston bores 11.

As the control surface force $F_S$ is not parallel to the axis of rotation 3, its control surface force component $F_{SK}$, which is parallel to the axis of rotation 3, is smaller.

According to the invention the forces acting oppositely on the cylinder 9 in an axial direction counterbalance each other. If allowance is made for the fact that the control surface force component $F_{SK}$ is at a smaller distance a from the axis of rotation 3 than the resultant loading force $F_{ER}$, the distance of which from the axis of rotation 3 is denoted with b, then, in comparison with the control surface force component $F_{SK}$, the magnitude of the resultant loading force $F_{ER}$ is comparatively smaller in order to produce force equilibrium. In order to achieve this force equilibrium, the working surfaces (diameter d) of the loading cylinders 24 are designed accordingly.

As the control surface force $F_S$ is directed obliquely, this produces a radial force component $F_R$ which loads the cylinder 9 radially. In order to make this radial force component $F_R$ harmless, according to the invention the size of the radius R of the control surface 13 is designed such that the force lines of the control surface force $F_S$ and of the resultant loading force $F_{ER}$ intersect at a point S, lying on the transverse plane A, at which the cylinder 9 is radially supported. This development does not allow the radial force component $F_R$ to exert a tilting moment on the cylinder 9.

The embodiment of the second exemplary embodiment according to FIG. 2 differs from the first embodiment simply by the fact that the axes of the pistons 8 converge in the direction of the control surface 13. As a result, the pistons 8 are rotated on a path which tapers conically towards the control surface 13. In a development such as this, the size of the pressure field, and consequently of the control surface force $F_S$ also, is reduced in comparison with the first exemplary embodiment, which is also limited by a comparatively small effective distance a. In this exemplary embodiment, the loading force $F_{ER}$ is substantially oblique in comparison with the first exemplary embodiment. In principle, the same force ratios are produced in the second exemplary embodiment as in the first exemplary embodiment.

Figure 1:
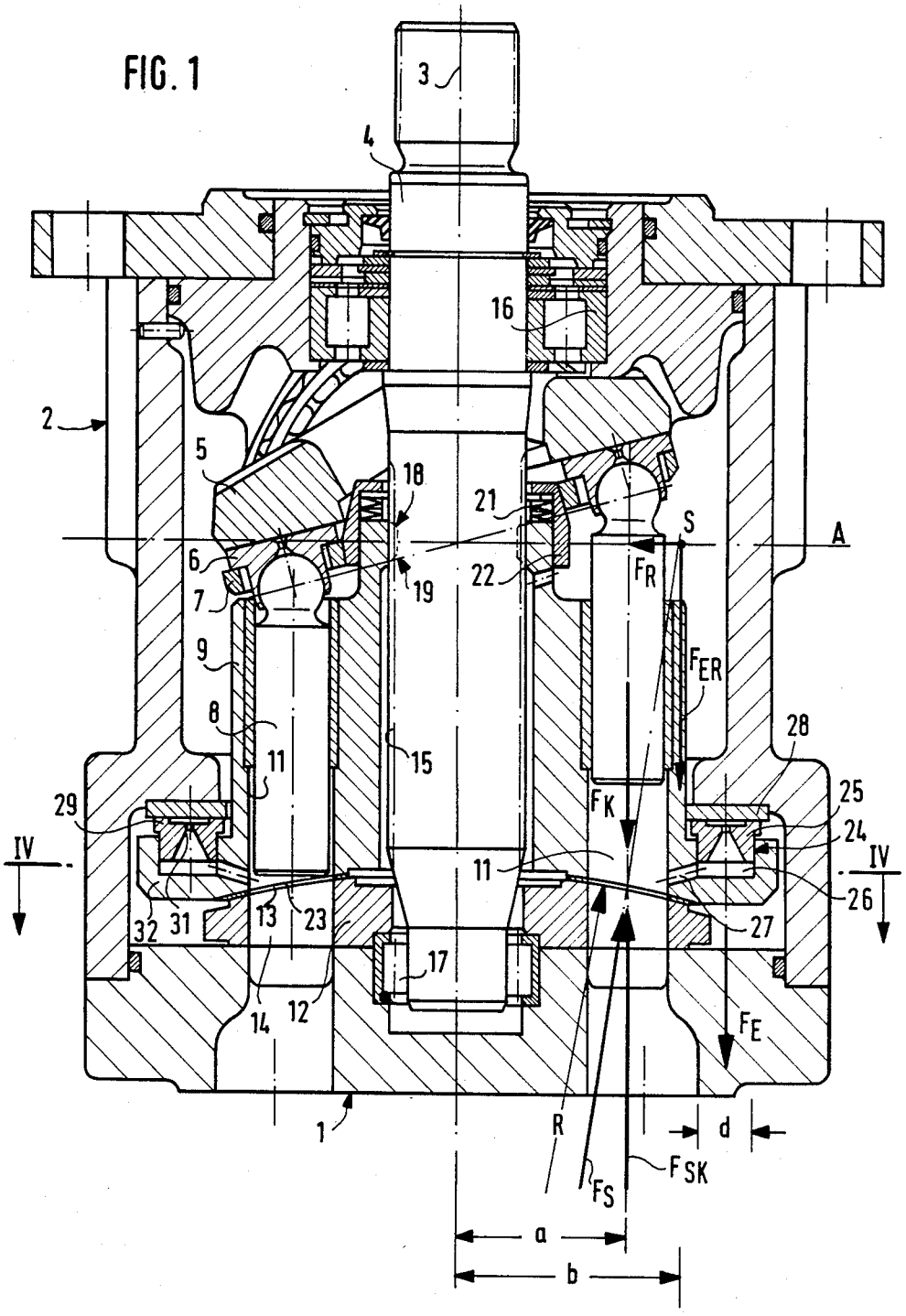
FIG. 1 shows an axial cross section through an axial piston machine according to the invention, as a first exemplary embodiment.
Figure 3:
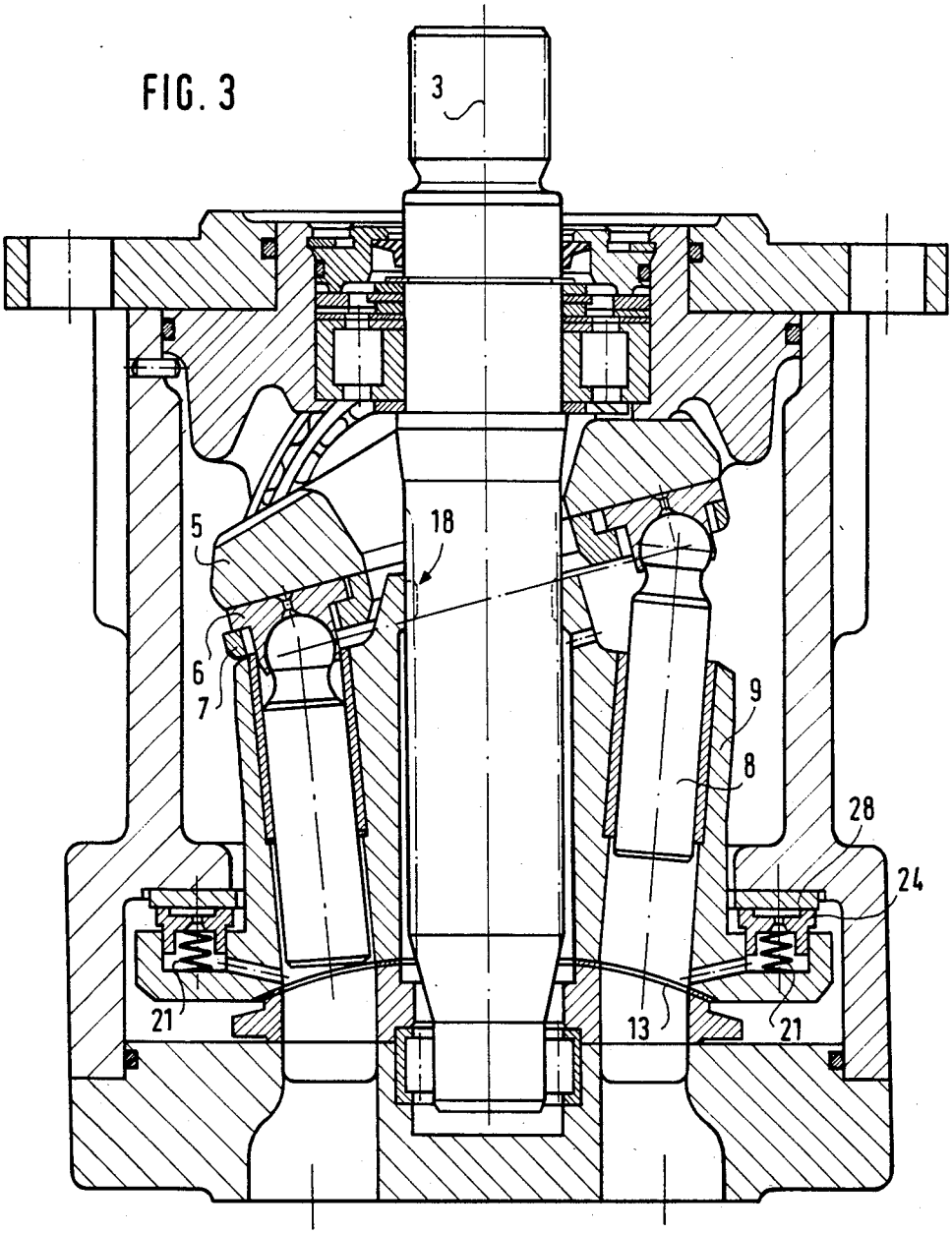
FIG. 3 shows an axial cross section through an axial piston machine according to the invention, as a third exemplary embodiment.

The third exemplary embodiment according to FIG. 3 differs from the second exemplary embodiment substantially by the fact that no pressure springs acting upon the cylinder 9 in the direction of the control surface 13 are provided, which pressure springs are denoted with 21 in FIG. 1. In place of this, corresponding springs 21 are provided in the loading cylinders where they cause both the pistons 24 to be lifted in the pressureless state and effective contact pressure of the cylinder 9 against the spherical control surface. A certain amount of contact pressure force is not harmful, as long as it is small.

Figures 4, 5:
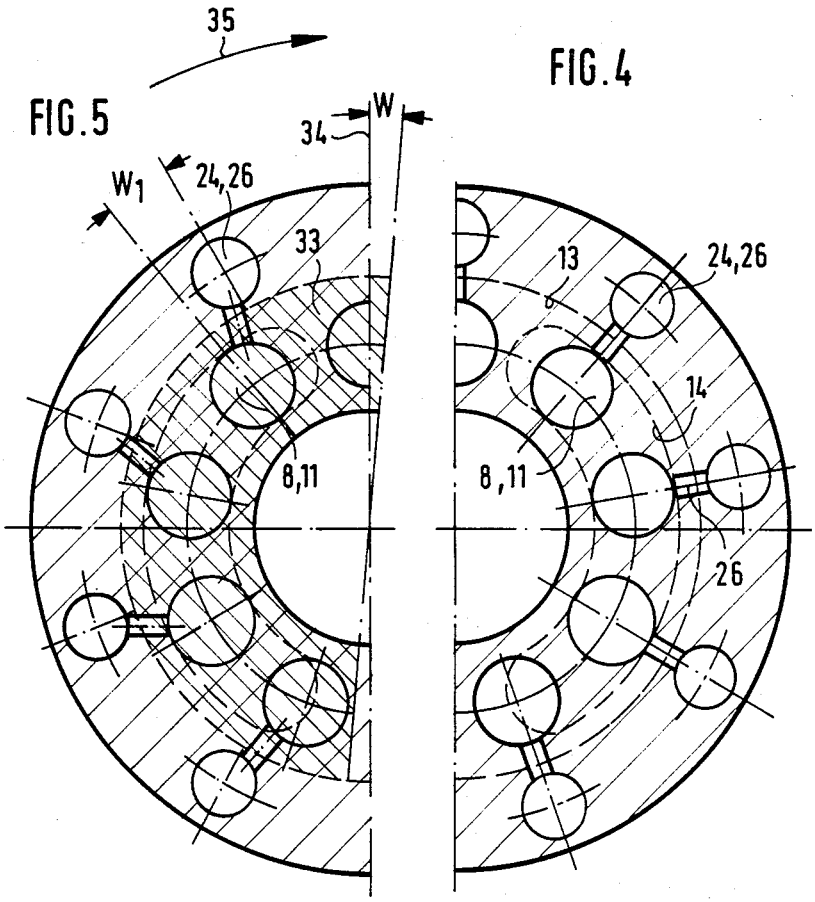
FIG. 4 shows a section through the axial piston machine according to FIG. 1, along the line IV—IV in FIG. 1, although rotated by 90° in a clockwise direction.
FIG. 5 shows a section, corresponding to FIG. 4, of a fourth exemplary embodiment, although rotated by 90° in an anticlockwise direction.

FIGS. 4 and 5 each show, alternately rotated by 90° respectively, a cross section through the axial piston machine according to FIG. 1, along the line IV—IV and in the plane of the connecting channels 27 respectively. It is to be noted that FIG. 5 shows, as a fourth exemplary embodiment, an embodiment which is altered in respect of FIG. 4. The control surface 13 is indicated by broken lines. The kidney shape of the control openings 14, likewise shown by broken lines, is clearly shown.

The fourth exemplary embodiment according to FIG. 5 differs from the first exemplary embodiment according to FIG. 4, in that the pressure field 33, indicated by crossbatching, of the control surface 13 is rotated by a set angle w relative to the dead centre axis 34. The loading cylinders 24 are rotated, in advance, in the same circumferential direction (see direction of rotation 35) by an angle $w_1$. As a result, the loading force $F_E$, adjusting to the build up or drop respectively of pressure in the piston spaces 11, likewise acts in advance.

What is claimed is:

1. An axial piston machine, preferably an axial piston pump of the inclined disc or skew axis type, with a cylinder which rotates about an axis of rotation and in which, on a pitch circle, several pistons are movable guided in piston bores extending substantially along the axis of rotation, by means of an inclined or driving disc, or the like, the piston bores opening at the face of the cylinder which is remote from the inclined or driving disc, the face resting against a control surface in which there are arranged control openings, positioned on the pitch circle of the pistons which, in set positions of rotation of the cylinder, are covered by the openings of the piston bores, loading cylinders being distributed over the circumference and acting upon the cylinder against the control surface, and of which loading cylinders the working spaces are connected, by means of connecting channels, each with a respective piston bore, and the cylinder being mounted on a drive shaft in an axially slidable manner, spring-loadable in the direction of the control face and supported radially, directly or indirectly, against a support mounting which is fixed relative to the housing and which is spaced axially from the control surface, characterized in that the piston bores open, without narrowing of cross section, at said face; in that said face is spherically concave and the control surface is correspondingly spherically convex; in that the axial portion of a control surface force, which acts upon the cylinder in the direction of the inclined or driving disc, counterbalances the loading force which acts upon the cylinder in the opposite direction; and in that the size of the radius of the control surface is such that the intersecting point of the control surface force perpendicular to the control surface and of the loading force lies in a plane which extends transversely to the axis of rotation and which is arranged in the region of the support mounting of the cylinder.

2. An axial piston machine of the inclined disc type, according to claim 1, characterised in that said plane and the support mounting are arranged in the region of the end of the cylinder which is remote from the control surface.

3. An axial piston machine of the inclined axis type, according to claim 1, characterised in that said plane extends in the region of the driving disc.

4. An axial piston machine, according to claim 1, characterised in that said plane and the wobble plane of the inclined disc or driving disc cross at the axis of rotation.

5. An axial piston machine, according to claim 1, characterised in that the piston bores extend in a straight line through the cylinder.

6. An axial piston machine, according to claim 1, characterised in that axes of the pistons and piston bores converge in the direction of the control surface.

7. An axial piston machine, according to claim 1, characterised in that in at least some of the loading cylinders evenly divided around the circumference there are positioned springs which load the cylinder in the direction of the control surface.

8. An axial piston machine, according to claim 1, characterised in that the loading pistons of the loading cylinders are supported against the housing through slip or bearing rings.

9. An axial piston machine, according to claim 1, characterised in that there is a respective loading cylinder for each piston.

10. An axial piston machine, according to claim 1, characterised in that the loading cylinders are offset by an angle ($w_1$), with respect to the pistons and piston bores in the direction of rotation.

* * * * *